US012089663B2

(12) United States Patent
Chou

(10) Patent No.: US 12,089,663 B2
(45) Date of Patent: Sep. 17, 2024

(54) GARMENT WITH CUPS

(71) Applicant: SOFT SENSE LIFE TECH PTE. LTD., Singapore (SG)

(72) Inventor: Kuan-Chien Chou, Taipei (TW)

(73) Assignee: SOFT SENSE LIFE TECH PTE. LTD., Singapore (SG)

( * ) Notice: Subject to any disclaimer, the term of this patent is extended or adjusted under 35 U.S.C. 154(b) by 162 days.

(21) Appl. No.: 17/705,455

(22) Filed: Mar. 28, 2022

(65) Prior Publication Data

US 2022/0346467 A1 Nov. 3, 2022

(30) Foreign Application Priority Data

Apr. 29, 2021 (CN) ..... 202110475163.5

(51) Int. Cl.
*A41C 3/12* (2006.01)

(52) U.S. Cl.
CPC ..... *A41C 3/122* (2013.01)

(58) Field of Classification Search
CPC ..... A41C 3/122; A41C 3/0021; A41C 3/128; A41C 3/0092
USPC ..... 450/41
See application file for complete search history.

(56) References Cited

U.S. PATENT DOCUMENTS

| | | | | |
|---|---|---|---|---|
| 911,204 | A * | 2/1909 | Busby | A41C 3/0021 450/86 |
| 5,304,215 | A * | 4/1994 | MacWhinnie | A61M 1/064 450/38 |
| 2012/0135667 | A1* | 5/2012 | Chan | A41C 3/0092 450/86 |
| 2018/0035724 | A1* | 2/2018 | Blibech | A41C 3/12 |

* cited by examiner

*Primary Examiner* — Timothy K Trieu

(57) ABSTRACT

The present invention provides a garment with cups, which includes a garment body, a cup part and an elastic support structure. The cup part is located at the position of the garment body corresponding to the breasts of a wearer, and has a cladding portion, a cup neck portion and an underwire portion. The cup neck portion and the underwire portion are respectively arranged on both sides of the cladding portion. The elastic support structure is set on the cladding portion of the cup part and provides a supporting force from the underwire portion to the cup neck portion.

12 Claims, 5 Drawing Sheets

GARMENT WITH CUPS

CROSS REFERENCE TO RELATED APPLICATIONS

This Non-provisional application claims priority under 35 U.S.C. § 119(a) on Patent Application No. 202110475163.5 filed in People's Republic of China on Apr. 29, 2021, the entire contents of which are hereby incorporated by reference.

BACKGROUND OF THE INVENTION

Field of the Invention

The present invention relates to a garment, in particular to a garment with cups.

Descriptions of the Related Art

In recent years, due to the rising awareness of healthy living, people pay more attention to physical health and posture than in the past, so the trend of sports has gradually become popular. According to different personal preferences, sports such as yoga, cycling, fitness, various ball sports, and even running are all favored by the public.

In general, women must wear suitable underwear during exercise to avoid displacement or shaking of their breasts, which may cause discomfort during exercise and even cause sports injuries (such as strains). To avoid breast displacement, one of the most effective ways is to use the steel ring to the under-bust design of the underwear to support the breast and limit the position of the breast. Another way to avoid breast displacement is to adopt a compression design in the position of the sports underwear corresponding to the chest, that is, to compress the breast through a comprehensive compression method so that it is not easy to shake, and then achieve a similar fixed effect.

However, the rigidity of the steel ring will cause extreme discomfort to the wearer, and long-term pressurization will also cause the discomfort of compression, so the above-mentioned solutions may be counterproductive. Therefore, how to solve the problem of breast displacement or shaking during exercise is indeed one of the most important issues at present.

SUMMARY OF THE INVENTION

In view of the foregoing, the invention is to provide a garment with cups. The garment with cups can provide upward support for the breasts of the wearer after wearing, fix the breasts with gentle force, and stabilize the shaking breasts during exercise by using the elastic support structure set in the cup part.

To achieve the above, the invention is to provide a garment with cups, which includes a garment body, a cup part, and an elastic support structure. The cup part is located at the position of the garment body corresponding to the breasts of a wearer, and has a cladding portion, a cup neck portion, and an underwire portion. The cup neck portion and the underwire portion are respectively arranged on both sides of the cladding portion. The elastic support structure is set on the cladding portion of the cup part and provides a supporting force from the underwire portion to the cup neck portion.

In one embodiment, the elastic support structure includes an elastic membrane.

In one embodiment, the elastic support structure has an elastic strip element, which has a first segment, a second segment, and a third segment, where the second segment is located between the first segment and the third segment.

In one embodiment, the thickness of the first segment of the elastic strip element is thicker than the thickness of the second segment, and the tension of the first segment of the elastic strip element is greater than the tension of the second segment of the elastic strip element.

In one embodiment, the thickness of the second segment of the elastic strip element is thicker than the thickness of the first segment or the third segment, and the tension of the second segment of the elastic strip element is greater than the tension of the first segment or the third segment.

In one embodiment, the elastic support structure is jointed with the cladding portion by a hot-pressing technique.

In one embodiment, the material of the elastic support structure is selected from silicon, polyurethane (PU), thermoplastic polyurethane (TPU), and thermoplastic elastomer (TPE).

In one embodiment, the elastic support structure is further contacted with the cup neck portion and/or the underwire portion.

In one embodiment, the elastic support structure is set on an outer side of the cup part. Among them, the outer side is the side of the garment with cups away from human skin after being worn.

As mentioned above, the garment with cups of the invention utilizes the elastic support structure to support the breast and provide supporting force from the underwire portion toward the cup neck portion to stabilize the breast. In addition, the garment with cups can provide gentle support and make the cup part have a firm covering through the tension of the elastic support structure.

The detailed technology and preferred embodiments implemented for the subject invention are described in the following paragraphs accompanying the appended drawings for people skilled in this field to well appreciate the features of the claimed invention.

BRIEF DESCRIPTION OF THE DRAWINGS

The parts in the drawings are not necessarily drawn to scale, the emphasis instead being placed upon clearly illustrating the principles of at least one embodiment. In the drawings, like reference numerals designate corresponding parts throughout the various diagrams, and all the diagrams are schematic.

DESCRIPTION OF THE PREFERRED EMBODIMENT

In the following description, this invention will be explained with reference to embodiments thereof. However, the description of these embodiments is only for purposes of illustration rather than limitation.

Figure 1:
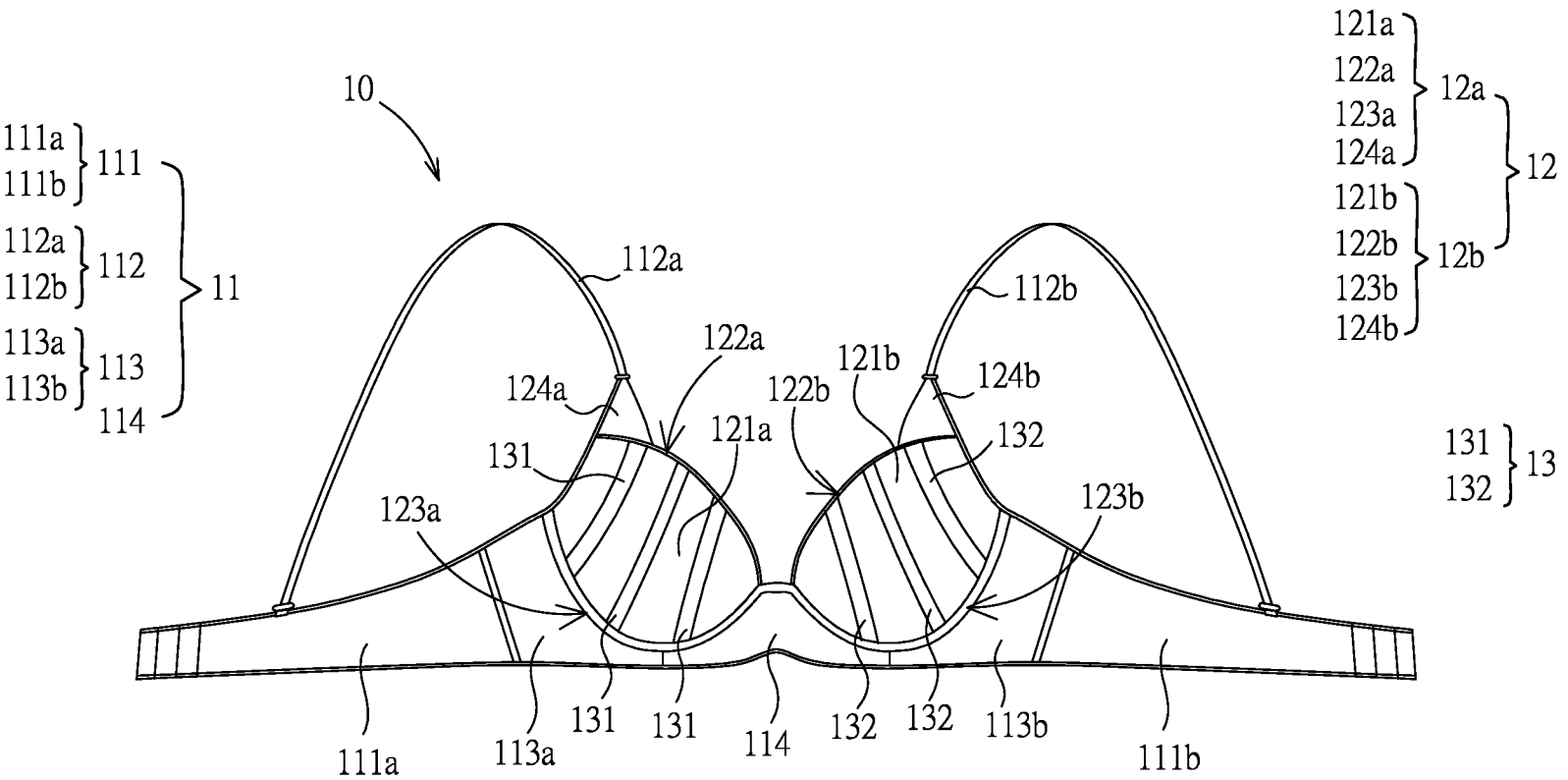
FIG. 1 is a schematic diagram of a garment with cups according to the first embodiment of the invention.

Refer to FIG. 1, a garment 10 with cups according to the first embodiment of the invention is illustrated by taking female underwear as an example. The garment 10 includes a garment body 11, a cup part 12, and an elastic support structure 13. Since the garment 10 in the embodiment is female underwear, the garment body 11 includes a wing part 111, a strap part 112, a cradle part 113, and a bridge part 114.

The cup part 12 is located at the position of the garment body 11 corresponding to the breasts of the wearer and has a first cup 12*a* and a second cup 12*b* adjacent to each other. The first cup 12*a* has a first cladding portion 121*a*, a first cup neck portion 122*a*, and a first underwire portion 123*a*. Among them, the first cup neck portion 122*a* and the first underwire portion 123*a* are respectively located on both sides of the first cladding portion 121*a*. In the embodiment, the first cup neck portion 122*a* and the first underwire portion 123*a* are respectively located on the upper and lower sides of the first cladding portion 121*a*. The second cup 12*b* has a second cladding portion 121*b*, a second cup neck portion 122*b*, and a second underwire portion 123*b*. Among them, the second cup neck portion 122*b* and the second underwire portion 123*b* are respectively located on both sides of the second cladding portion 121*b*. It should be noted that the cup part 12 can be but not limited to a full cup, a half cup, or a demi cup, etc.

The bridge part 114 is arranged between the first cup 12*a* and the second cup 12*b* of the cup part 12. The wing part 111 has a first wing 111*a* and a second wing 111*b*. The first wing 111*a* is connected to the side of the first cup 12*a* opposite to the bridge part 114, and the second wing 111*b* is connected to the side of the second cup 12*b* opposite to the bridge part 114. The cradle part 113 has a first connection part 113*a* and a second connection part 113*b*. The first connection part 113*a* is connected between the first wing 111*a* and the first cup 12*a*, and the second connection part 113*b* is connected between the second wing 111*b* and the second cup 12*b*. The strap part 112 has a first strap 112*a* and a second strap 112*b*. One end of the first strap 112*a* is connected to a first strap platform 124*a* of the first cup 12*a*, and the other end is connected to the middle section of the first wing 111*a*. One end of the second strap 112*b* is connected to a second strap platform 124*b* of the second cup 12*b*, and the other end is connected to the middle section of the second wing 111*b*.

The elastic support structure 13 is located on the outside of the cup part 12 and includes a first elastic strip element 131 and a second elastic strip element 132, which are an elastic membrane, respectively. The first elastic strip element 131 is disposed in the first cladding portion 121*a* of the cup part 12, and the second elastic strip element 132 is disposed in the second cladding portion 121*b* of the cup part 12. In the above, the so-called outer side refers to the side of the garment 10 away from the skin of the human body after being worn on the human body. In the first cup 12*a*, the first elastic strip element 131 provides a first supporting force, which is the supporting force from the first underwire portion 123*a* to the first cup neck portion 122*a*. In the second cup 12*b*, the second elastic strip element 132 provides a second supporting force, which is the supporting force from the second underwire portion 123*b* to the second cup neck portion 122*b*.

The material of the elastic support structure 13 is selected from silicon, polyurethane (PU), Thermoplastic polyurethane (TPU), thermoplastic elastomer (TPE) and combinations thereof. In another embodiment, when the elastic support structure 13 is made of biocompatible material, it can also be arranged on the inner side of the cup part 12, that is, the side that can be in contact with human skin. In another embodiment, the elastic support structure 13 can also be embedded in the cup part 12.

In the embodiment, the elastic support structure 13 may be combined with the first cup 12*a* or the second cup 12*b* by a hot-pressing technique. In other embodiments, the elastic support structure 13 may also be glued with the first cup 12*a* or the second cup 12*b* through an adhesive, where the adhesive can include, but is not limited to, full coating or matrix dot coating. In other embodiments, the elastic support structure 13 may also be partially hot-pressed and partially glued to the first cup 12*a* or the second cup 12*b*.

The number of the first elastic strip element 131 and the number of the second elastic strip element 132 can be selected according to requirements. In the embodiment, three pieces of the first elastic strip element 131 and three pieces of the second elastic strip element 132 are used as an example for description. In the first cup 12*a*, the first elastic strip element 131 is arranged substantially longitudinally on the first cup 12*a*, in detail, the first elastic strip element 131 passes through the first cladding portion 121*a* from a side close to the first cup neck portion 122*a* and extends to a side close to the first underwire portion 123*a*. Similarly, in the second cup 12*b*, the second elastic strip element 132 extends from the side close to the second cup neck portion 122*b* through the second cladding portion 121*b* to the side close to the second underwire portion 123*b* and is substantially longitudinally arranged in the second cup 12*b*. It is to be noted that one end of the first elastic strip element 131 can be in contact with the first cup neck portion 122*a*, the other end of the first elastic strip element 131 can be in contact with the first underwire portion 123*a*, and the remaining part is in contact with the first cladding portion 121*a*. In addition, one end of the second elastic strip element 132 can be in contact with the second cup neck portion 122*b*, the other end of the second elastic strip element 132 can be in contact with the second underwire portion 123*b*, and the remaining part is in contact with the second cladding portion 121*b*.

When the elastic support structure has a plurality of elastic strip elements as described above, the elastic support structure can not only provide a support force to the breast from the underwire portion to the cup neck portion but also can provide the breast with better coverability to cover and support the breast more comprehensively and restrain the shaking of the breast.

In addition, it is should be noted that a single first elastic strip element 131 or a single second elastic strip element 132 can have different tensions, which can be achieved in different ways. The following is an example of the first elastic strip element 131 in conjunction with FIG. 2A to FIG. 2D.

Figure 2A:
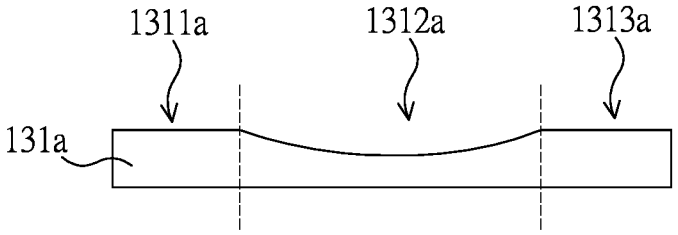
FIGS. 2A to 2D are schematic diagrams of an example of a first elastic strip element within the garment with cups according to the invention.

As shown in FIG. 2A, the first elastic strip element 131*a* has a first segment 1311*a*, a second segment 1312*a*, and a third segment 1313*a*, wherein the second segment 1312*a* is located between the first segment 1311*a* and the third segment 1313*a*. In the embodiment, the thicknesses of the first segment 1311*a* and the third segment 1313*a* are thicker than the thickness of the second segment 1312*a* and the thickness of the second segment 1312*a* is gradually changed, that is, the thickness of the first elastic strip element 131*a* is thinner toward the center. It is conceivable that the first elastic strip element 131*a* can provide greater tension in a thicker section through the difference in thickness.

Figure 2B:
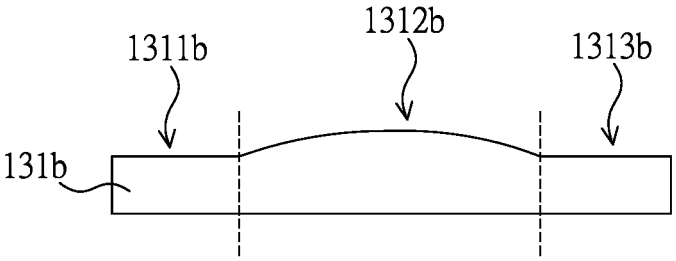

As shown in FIG. 2B, the first elastic strip element 131*b* has a first segment 1311*b*, a second segment 1312*b*, and a third segment 1313*b*, wherein the second segment 1312*b* is located between the first segment 1311*b* and the third segment 1313*b*. In the embodiment, the thicknesses of the first segment 1311*b* and the third segment 1313*b* are thinner than the thickness of the second segment 1312*b* and the thickness of the second segment 1312*b* is gradually changed, that is, the thickness of the first elastic strip element 131*b* is thicker toward the center. It is conceivable that the first elastic strip element 131*b* can provide greater tension in a thicker section through the difference in thickness.

Figure 2C:
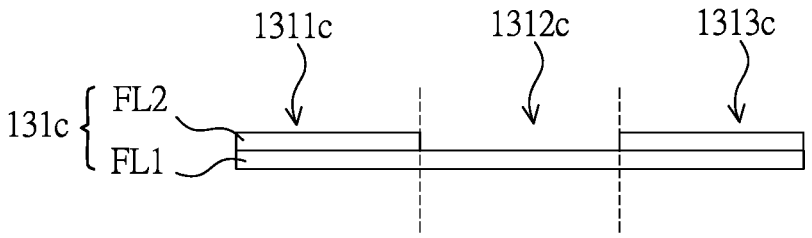

As shown in FIG. 2C, the first elastic strip element 131*c* has a first segment 1311*c*, a second segment 1312*c*, and a third segment 1313*c*, wherein the second segment 1312*c* is located between the first segment 1311*c* and the third segment 1313*c*. In the embodiment, the first elastic strip element 131*c* has a first elastic membrane layer FL1 and a second elastic membrane layer FL2, wherein, the second elastic membrane layer FL2 is stacked on the first elastic membrane layer FL1 by the hot-pressing technique or adhesive. As shown in FIG. 2C, the second elastic membrane layer FL2 is provided in the segments of the first segment 1311*c* and the third segment 1313*c*. It is conceivable that the first elastic strip element 131*c* can provide greater tension in a thicker section through the difference in thickness.

Figure 2D:
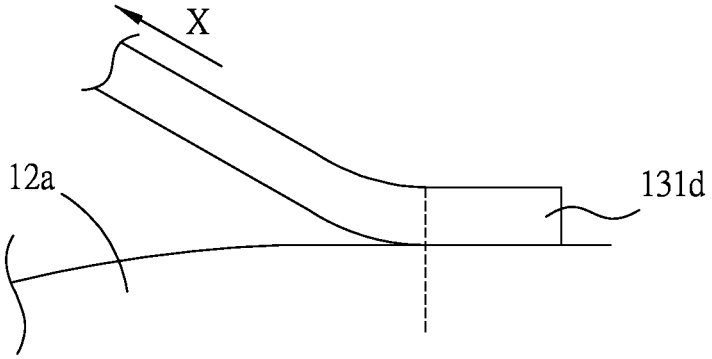

As shown in FIG. 2D, in the process of combining the first elastic strip element 131*d* with the first cup 12*a*, it includes providing a force along the X-axis direction to the first elastic strip element 131*d* so that the first elastic strip element 131*d* is bonded to the first cup 12*a* after being stretched and deformed. The first elastic strip element 131*d* can have different tensions in different sections by controlling the pre-stretching force. For example, combining the first elastic strip element 131*d* with the first cup 12*a* while providing a larger pre-stretching force will make this section have a larger tension, in other words, the strength of the tension is related to the strength of the pre-stretching force.

Figure 3:
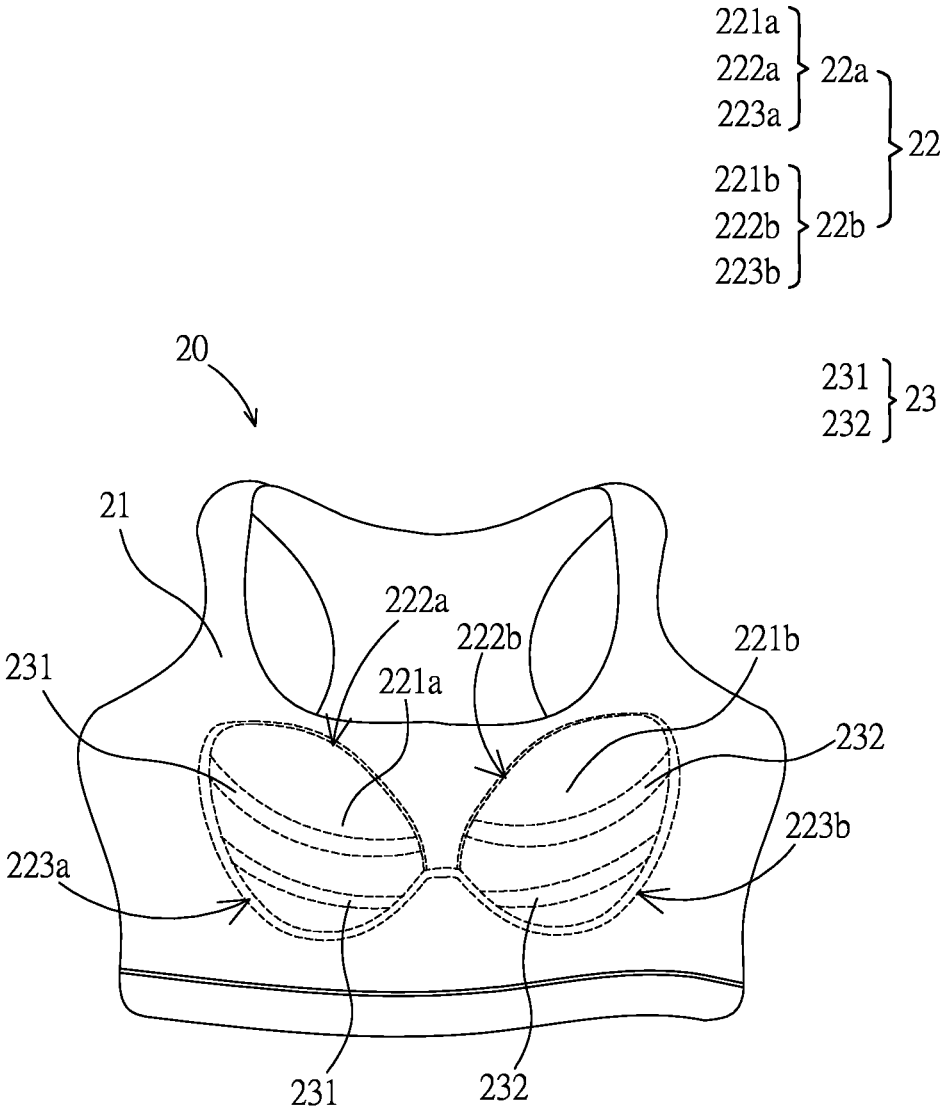
FIG. 3 is a schematic diagram of a garment with cups according to the second embodiment of the invention.

Next, please refer to FIG. 3, the garment 20 with the cups according to a second embodiment of the invention is described by taking sports underwear for women as an example. The garment 20 includes a garment body 21, a cup part 22, and an elastic support structure 23. The garment body 21 may include but is not limited to an elastic vest or T-shirt. The cup part 22 is located inside the garment body 21 at a position corresponding to the breasts and has a first cup 22*a* and a second cup 22*b* adjacent thereto. The first cup 22*a* has a first cladding portion 221*a*, a first cup neck portion 222*a*, and a first underwire portion 223*a*, wherein the first cup neck portion 222*a* and the first underwire portion 223*a* are respectively located on both sides of the first cladding portion 221*a*. The second cup 22*b* has a second cladding portion 221*b*, a second cup neck portion 222*b*, and a second underwire portion 223*b*, wherein the second cup neck portion 222*b* and the second underwire portion 223*b* are respectively located on both sides of the second cladding portion 221*b*. The structures and related features of the first cup 22*a* and the second cup 22*b* are the same as the first cup 12*a* and the second cup 12*b* of the first embodiment, so they will not be repeated.

The elastic support structure 23 is located on the outer side of the cup part 22. In the embodiment, the elastic support structure 23 is located between the cup part 22 and the garment body 21. The elastic support structure 23 includes a first elastic strip element 231 and a second elastic strip element 232, which are the elastic membrane. The structural features of the first elastic strip element 231 and the second elastic strip element 232 are the same as the first elastic strip element 131 and the second elastic strip element 132 in the first embodiment, so they will not be described again.

It should be noted that in the first embodiment, the first elastic strip element 131 and the second elastic strip element 132 are arranged vertically, and in the second embodiment, the first elastic strip element 231 and the second elastic strip element 232 are arranged laterally. It should be noted that even in a lateral arrangement, the first elastic strip element 231 and the second elastic strip element 232 still provide upward supporting force. To further illustrate, in the first cup 22*a*, the first elastic strip element 231 provides a first supporting force, which is the supporting force in the direction of the first cup neck portion 222*a* from the first underwire portion 223*a*. In the second cup 22*b*, the second elastic strip element 232 provides a second supporting force, which is the supporting force in the direction from the second underwire portion 223*b* to the second cup neck portion 222*b*.

Figure 4A:
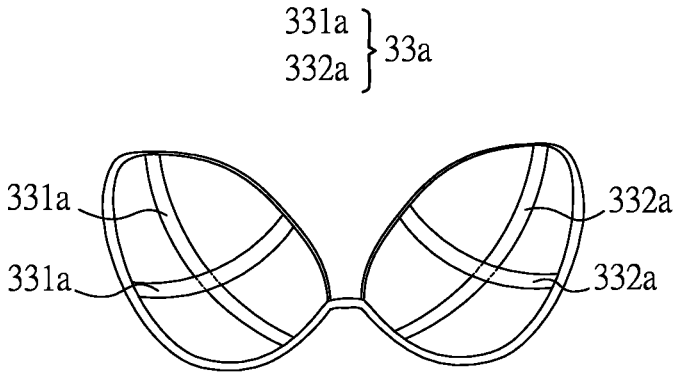
FIG. 4A is a schematic diagram showing that the elastic strip element of the elastic support structure is staggered.
Figure 4B:
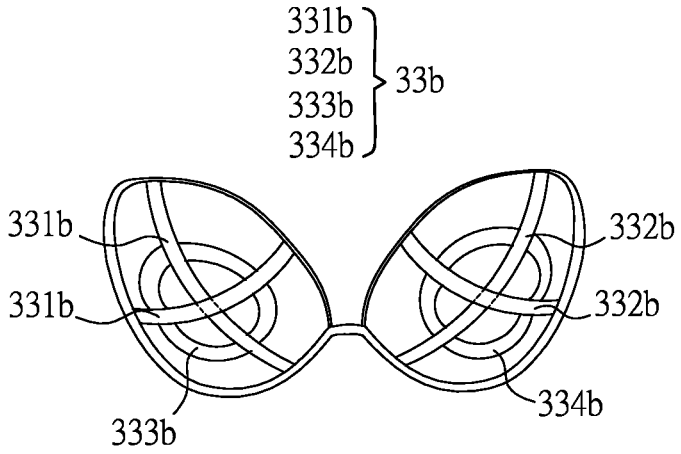
FIG. 4B is a schematic diagram showing that the elastic strip element of the elastic support structure is staggered and has auxiliary elements.

In other embodiments, the elastic strip elements in the elastic support structure may be arranged in parallel with each other, arranged radially, or arranged in a staggered manner, in other words, the elastic support structure can provide multi-directional support, distributed support, or aggregated support. For example, FIG. 4A shows an embodiment in which the first elastic strip element 331*a* and the second elastic strip element 332*a* in the elastic support structure 33*a* are respectively staggered. For another example, FIG. 4B shows that the first elastic strip element 331*b* and the second elastic strip element 332*b* are respectively provided with the first auxiliary element 333*b* and the second auxiliary element 334*b* in addition to being staggered respectively. The purpose of disposing of the elastic support structure is to stably wrap the breasts and provide proper support and wrapping ability so that the wearer can effectively suppress the shaking of the breasts and reduce discomfort during exercise.

In summary, the garment with cups of the invention utilizes the elastic support structure to support the breasts, provides the support force from the underwire portion toward the cup neck portion, and provides the omnidirectional wrapping force to stabilize position of the breast. The adjustable or controllable tension is provided by the elastic support structure similar to the bionic tendon, which can provide proper support force and wrapping ability for the breast and make the cup part have a stable wrapping property. In addition, a single elastic strip element in the elastic support structure can be designed to have different tensions. In other words, by using the elastic support structure formed by more the elastic strip elements, more diverse tensions including multi-directional, distributed, aggregated, or nonlinear tensions can be provided.

The above embodiments merely give the detailed technical contents of the present invention and inventive features thereof and are not to limit the covered range of the present invention. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A garment with cups, comprising:

a garment body;

a cup part, which is located at the position of the garment body corresponding to the breasts of a wearer when is worn, the cup part has a cladding portion, a cup neck portion, and an underwire portion, wherein the cup neck portion and the underwire portion are respectively arranged on both sides of the cladding portion; and an elastic support structure, which has an elastic strip element and is attached to the cladding portion of the cup part and provides a supporting force from the underwire portion to the cup neck portion;

wherein the elastic strip element is divided into at least a first segment and a second segment, where the thickness of the second segment differs from the thickness of the first segment.

2. The garment with cups of claim 1, wherein the elastic support structure comprises an elastic membrane.

3. The garment with cups of claim 1, wherein the elastic strip element is further divided into the first segment, the second segment, and a third segment, where the second segment is located between the first segment and the third segment, wherein the thickness of the first segment differs from the thickness of the third segment or the thickness of the second segment differs from the thickness of the third segment.

4. The garment with cups of claim 3, wherein the thickness of the first segment of the elastic strip element is thicker than the thickness of the second segment.

5. The garment with cups of claim 4, wherein the tension of the first segment of the elastic strip element is greater than the tension of the second segment of the elastic strip element.

6. The garment with cups of claim 3, wherein the thickness of the second segment of the elastic strip element is thicker than the thickness of the first segment or the third segment.

7. The garment with cups of claim 6, wherein the tension of the second segment of the elastic strip element is greater than the tension of the first segment or the third segment.

8. The garment with cups of claim 1, wherein the elastic support structure is jointed with the cladding portion by a hot-pressing technique.

9. The garment with cups of claim 1, wherein the elastic support structure is further contacted with the cup neck portion and/or the underwire portion.

10. The garment with cups of claim 1, wherein the elastic support structure is set on an outside of the cup part.

11. The garment with cups of claim 1, wherein the elastic support structure comprises a first elastic membrane layer and a second elastic membrane layer, which is stacked on the first elastic membrane layer.

12. The garment with cups of claim 11, wherein the first elastic membrane layer and the second elastic membrane layer are stacked by a hot-pressing technique or an adhesive manner.

* * * * *